US010875702B1

(12) United States Patent
Shoemaker, Jr.

(10) Patent No.: US 10,875,702 B1
(45) Date of Patent: Dec. 29, 2020

(54) HIGH SPEED TICKET DISPENSER

(71) Applicant: Stephen P. Shoemaker Trust, Manhattan Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 16/552,871

(22) Filed: Aug. 27, 2019

(51) Int. Cl.
*B65D 83/08* (2006.01)
*B65D 83/12* (2006.01)
*G07F 17/42* (2006.01)

(52) U.S. Cl.
CPC ..... *B65D 83/0805* (2013.01); *B65D 83/12* (2013.01); *G07F 17/42* (2013.01)

(58) Field of Classification Search
CPC .... B65D 83/12; B65D 83/0805; B65H 29/12; B65H 29/125; G07B 3/02; G07B 3/04; G07B 5/06; G07F 17/32; G07F 17/42
See application file for complete search history.

(56) References Cited

U.S. PATENT DOCUMENTS 3,545,742 A * 12/1970 Muller ..... B65H 7/04 271/10.03
3,885,782 A * 5/1975 Wright ..... G03B 27/6264 271/10.05
3,961,759 A * 6/1976 Fujiwara ..... B65H 18/20 242/532.2
4,011,811 A * 3/1977 Kodis ..... B41J 3/54 101/93.07
4,113,245 A * 9/1978 Colglazier ..... B65H 3/5223 271/10.11
RE29,792 E * 10/1978 Tramposch ..... G06K 7/10 209/583
4,157,670 A * 6/1979 Herring ..... G07B 3/02 83/165
4,690,348 A * 9/1987 Watanabe ..... B65H 18/00 242/532
4,828,406 A * 5/1989 Mosciatti ..... G07B 1/00 101/69
5,024,350 A * 6/1991 Shoemaker, Jr. ..... G07F 11/42 221/152
5,273,226 A * 12/1993 Dropczynski ..... B65H 19/2246 242/521
5,386,950 A * 2/1995 Abt ..... B65H 18/20 242/532
5,449,164 A * 9/1995 Quesnel ..... B65H 15/00 271/186
5,465,948 A * 11/1995 Weller ..... B65H 3/5261 271/121

(Continued)

*Primary Examiner* — Gene O Crawford
*Assistant Examiner* — Kelvin L Randall, Jr.
(74) *Attorney, Agent, or Firm* — Fulwider Patton LLP

(57) ABSTRACT

A high speed paper ticket dispenser is disclosed wherein a motor that drives a drive roller having a smooth contact surface is in proximity with an idler roller. An endless round belt that moves tickets rapidly serves as the drive roller. A supply of paper tickets from a tray, roll, or other is fed between the two rollers, and the motor causes the driver roller to push the tickets through a ticket dispensing slot in a game or other device. To prevent improper withdrawal of tickets from outside the dispensing slot, a wedge or brake is applied by a motor lever or solenoid between the ticket chain and the drive roller to resist movement of the tickets. The wedge or brake is automatically withdrawn when the motor engages and the drive roller begins to dispense tickets.

6 Claims, 9 Drawing Sheets

(56) References Cited

U.S. PATENT DOCUMENTS

| | | | | | |
|---|---|---|---|---|---|
| 5,833,104 | A * | 11/1998 | Horniak | G07B 3/02 | 225/106 |
| 6,161,743 | A * | 12/2000 | Shoemaker, Jr. | G07B 3/00 | 226/156 |
| 6,578,735 | B1 * | 6/2003 | Mothwurf | G06Q 30/0212 | 221/255 |
| 2012/0085777 | A1 * | 4/2012 | Bucci | G07F 11/42 | 221/30 |
| 2016/0171784 | A1 * | 6/2016 | Chen | G07B 5/02 | 225/23 |
| 2018/0115677 | A1 * | 4/2018 | Tamura | B65H 79/00 | |

* cited by examiner

HIGH SPEED TICKET DISPENSER

BACKGROUND

Many arcade games include a ticket dispenser for dispensing redemption tickets to winners of the game. Some games dispense tens, hundreds, or even thousands of tickets for a single win. Prior ticket dispensers utilize a pressure roller system with two knurled rollers that push the tickets to the customer. These pressure rollers squeezed the tickets tightly, frequently jam, and tend to damage the paper tickets. This tight squeeze function requires a drive motor with a lot of torque, pressure, and drag built into the gearing. Such a system is very slow and prone to severe jams because of the drive force used, necessitating many repairs and servicing.

SUMMARY OF THE INVENTION

To overcome the shortcomings of the prior art, the present invention presents a rapid ticket dispensing system that uses a low torque and very high speed rotating belt to move the tickets. Because of the light weight nature of tickets, it does not take much pressure to push these tickets. In the past there have been disc drive dispensers using an O-ring. The circumference of an O-ring may be 2 inches where the length of the belt is more than 20 inches. The diameter of the belt is more than twice that of the ring. This greatly extends the life of the drive due to running, speed, pressure or other factors.

The inherent problem in decreasing torque for speed is the reduction in drag. A very fast drive has little drag so a brake is needed to control the movement or stooping. There are many braking systems, but a simple method is a solenoid that releases a wedge that bears against two rollers. When the solenoid retracts the wedge, the tickets flow smoothly and rapidly. When the motor stops, the solenoid releases the wedge and allows it to squeeze the tickets between the two rollers adding the pinch so they cannot be pulled from the game. The solenoid pulls in the wedge when the motor runs, and releases or extends the wedge into the rollers when the motor stops. Exchanging a motor and pivot gives the same result but is stronger than a solenoid if needed.

A major improvement of the present invention is that it is belt driven, whereas most ticket dispensers are roller driven using knurled wheels and pressure to move and hold the ticket. The roller system of the prior art limits the speed. Moreover, a ring, like an O-ring, will flatten out over time and lose shape. The length of an O-ring is about two inches in circumference while a belt can be a foot or more in length and a larger diameter than the ring. Belts are also made of more durable material, and will outlast an O-ring many times over. This allows for significantly higher speeds to be achieved, as the tickets are dispensed as fast as the belt can be driven and the present system can easily dispense over two thousand tickets a minute, compared with about one fifty tickets per minute for current technology.

Since the paper tickets are so light it takes only weak pressure and torque to move tickets rapidly, but weak pressure will not hold the ticket so it will tear. Cutting the ticket is an option but complicated. Also, the thicker and wider the ticket the more pressure is needed to have the paper tear. Pressure depends on torque so a holding mechanism is needed to have the ticket tear and not be pulled out of the game. This problem is solved by a simple solenoid or gear motor lever system that jams the ticket, holding it securely during the tearing operation. The wedge brake system holds the tickets so the player can't pull them from the machine. With speed comes less torque so tickets are less secure. For correct operation the solenoid must pull in before the ticket dispensing starts, thus removing the pressure that holds the ticket. If not, the motor will not start.

DETAILED DESCRIPTION OF THE PREFERRED EMBODIMENTS

Figure 1:
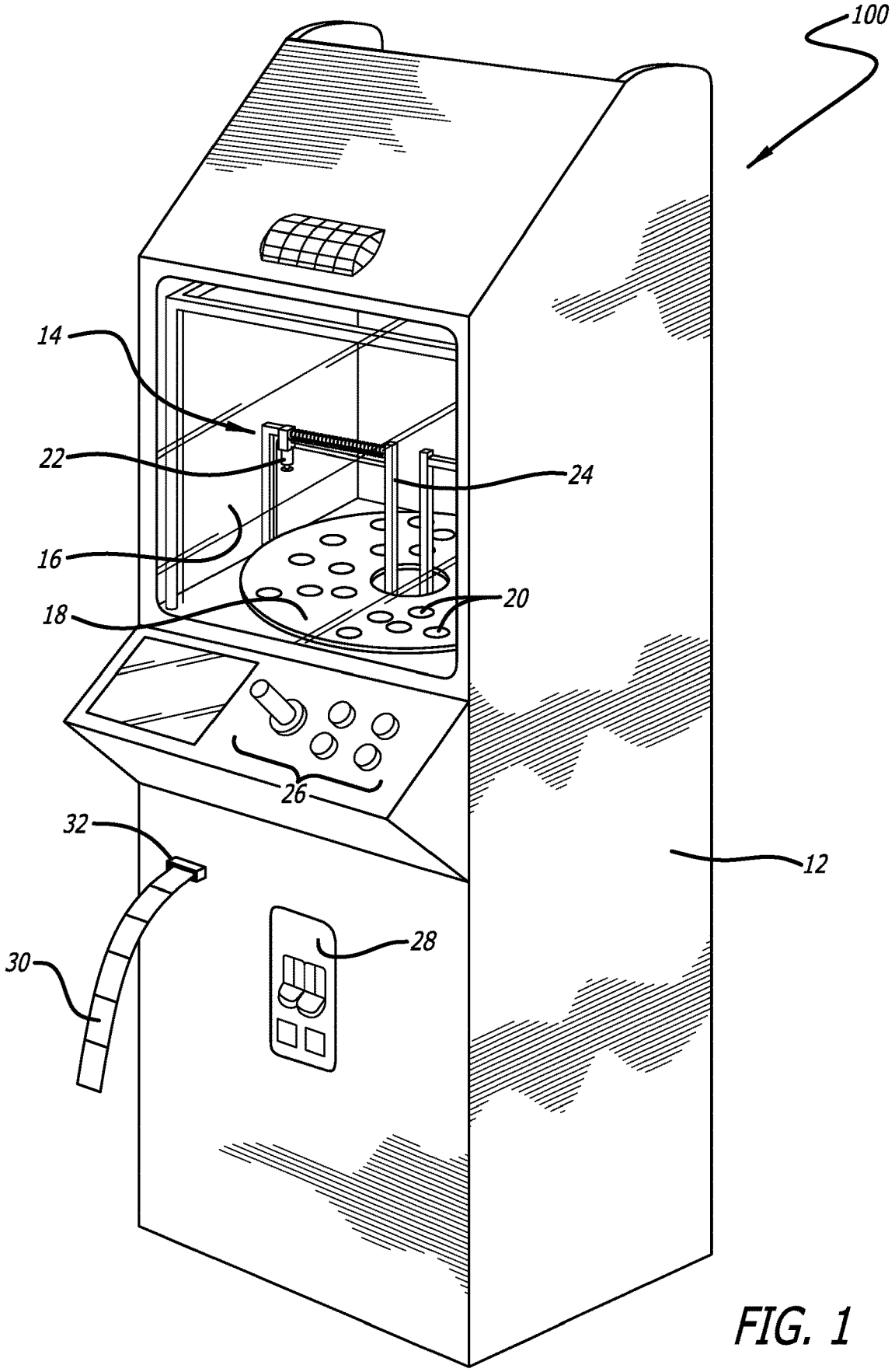
FIG. 1 is an arcade game of the type utilizing the present invention.

FIG. 1 illustrates an arcade game of the type that may be used to reward successful players with redemption tickets, such as those described in U.S. Pat. No. 7,192,342, the contents of which is incorporated herein by reference. Generally, a housing 12 for a game 100 includes a game play area 14 protected by a glass or plastic barrier 16. The game play area by include a playing field such as a rotating turntable 18 with targets or prizes 20 strewn on the playing field, and a maneuverable pick-up device 22 transported on a frame 24 and controlled by player controls 26. A payment device 28 receives payment for the game play, including coins, tokens, magnetic card credits, cash, and a variety of other forms of payment. If the player is successful, the game distributes one or more paper tickets 30 through a ticket distribution slot 32.

Figure 2:
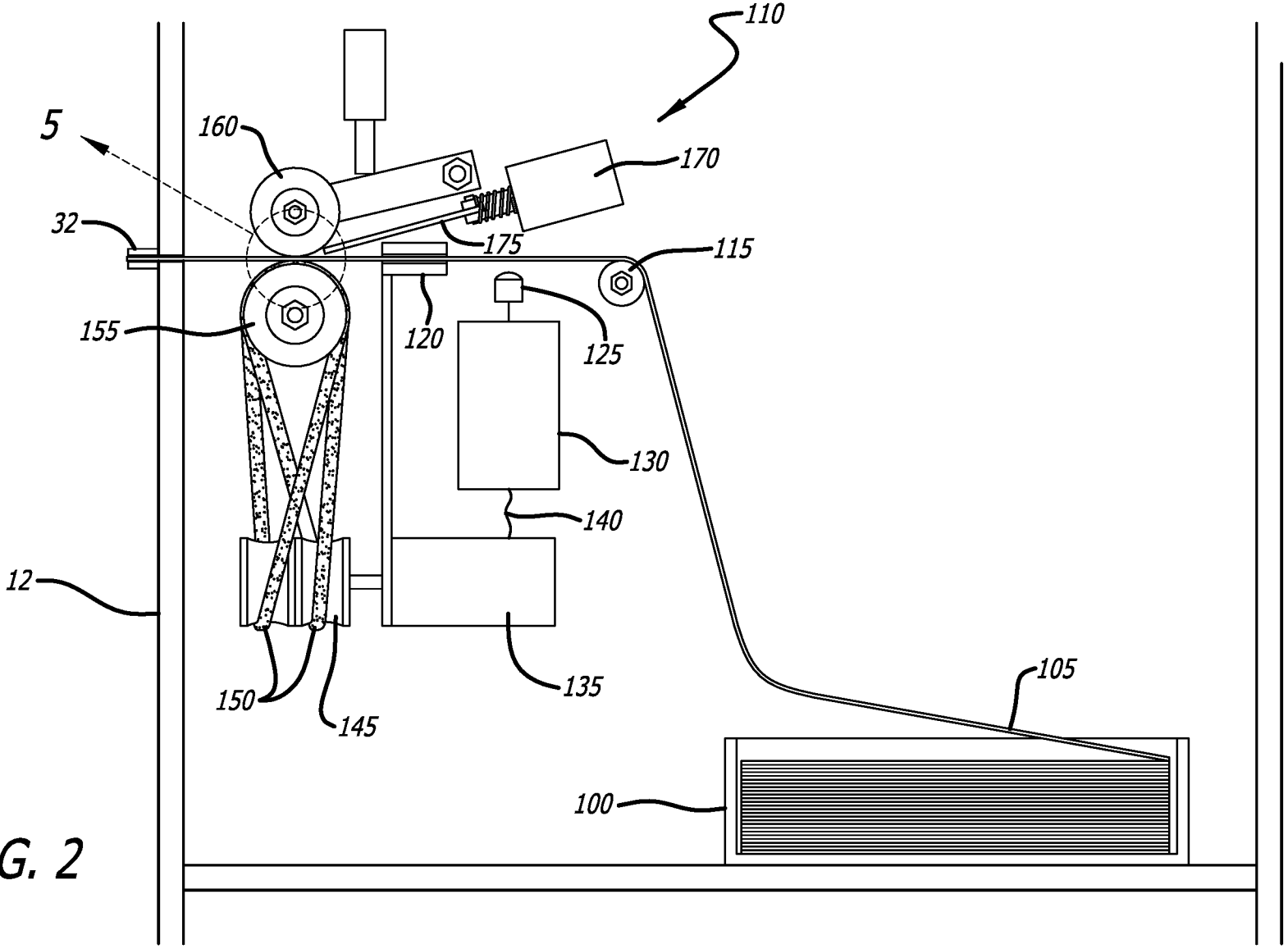
FIG. 2 is a side view partially in cross section of a first embodiment of a ticket dispenser of the present invention.
Figure 3:
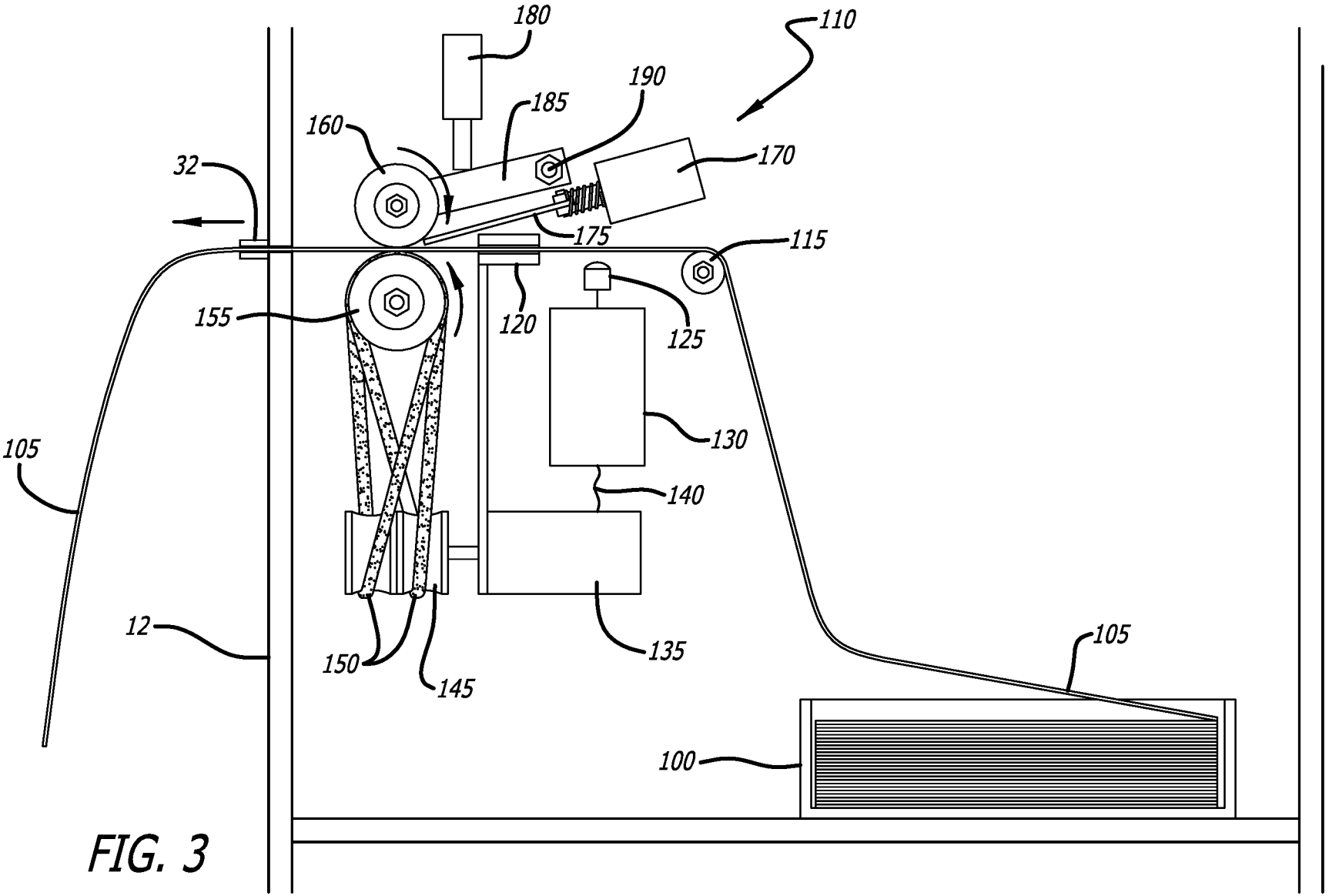
FIG. 3 is the side view of FIG. 2 with the tickets being dispensed through the ticket slot.

FIG. 2 illustrates a high speed ticket dispenser that is located in the housing 12 and includes a ticket supply in the form of a tray 100 of fan folded tickets 105, although the ticket supply could also include a roll or other arrangement. The tickets 105 are fed through the ticket dispenser 110 and out the game's distribution slot 32 so as to be collectable by the player. The ticket dispenser includes a guide roller 115 that passes the tickets past an optical counter 125 and through a feed slot 120. The optical counter 125 is connected to a motherboard 130 with a processor that controls the operation of the ticket dispenser 110. As tickets pass by the optical counter, they are counted and a signal is delivered to the processor that in turn controls the motor 135 via bus 140. The motor 135 rotates a drum 145 that carries a pair of belts 150, where the belts wrap around drive roller 155 to rotate the drive roller. Note that in the embodiment depicted in FIG. 3, the axis of rotation of the drum 145 and motor 135 is perpendicular to the axis of rotation of the drive roller 155, although other arrangements are possible.

The tickets 105 exiting the feed slot 120 are favorably moved by the drive roller and an idle roller 160 to pull the tickets from the tray 100. The force applied by the idle roller 160 can be managed by various means, such as for example a screw, spring, weight, servo, or solenoid 180. The screw, spring, or biasing means 180 applies a downward force on the idle roller radial arm 185 that pivots about pin 190 to control the counterforce of the idle roller 160.

The surface layer 205 of the drive roller 155 is preferably a smooth but textured round belt so as to lightly grip the tickets and force the tickets 105 through the slot 32 without damaging or crunching the tickets 105. When the motor 135 is running at full speed (FIG. 3), the tickets can be delivered at a rate of over two thousand tickets per minute, a rate that was heretofore not achievable in the prior art.

Figure 4:
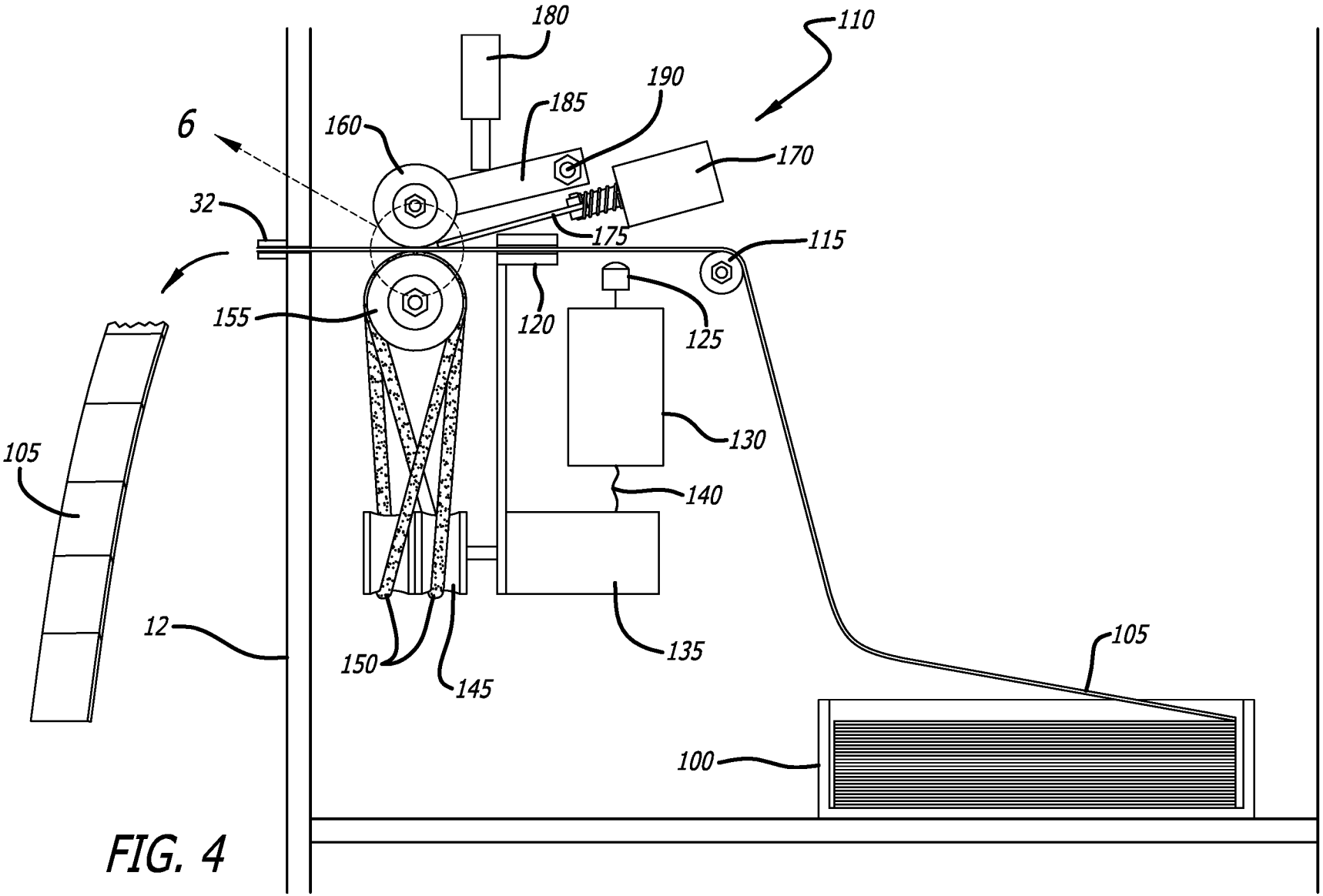
FIG. 4 is the side view of FIG. 2 showing the stop and tear feature of the present invention.
Figure 5:
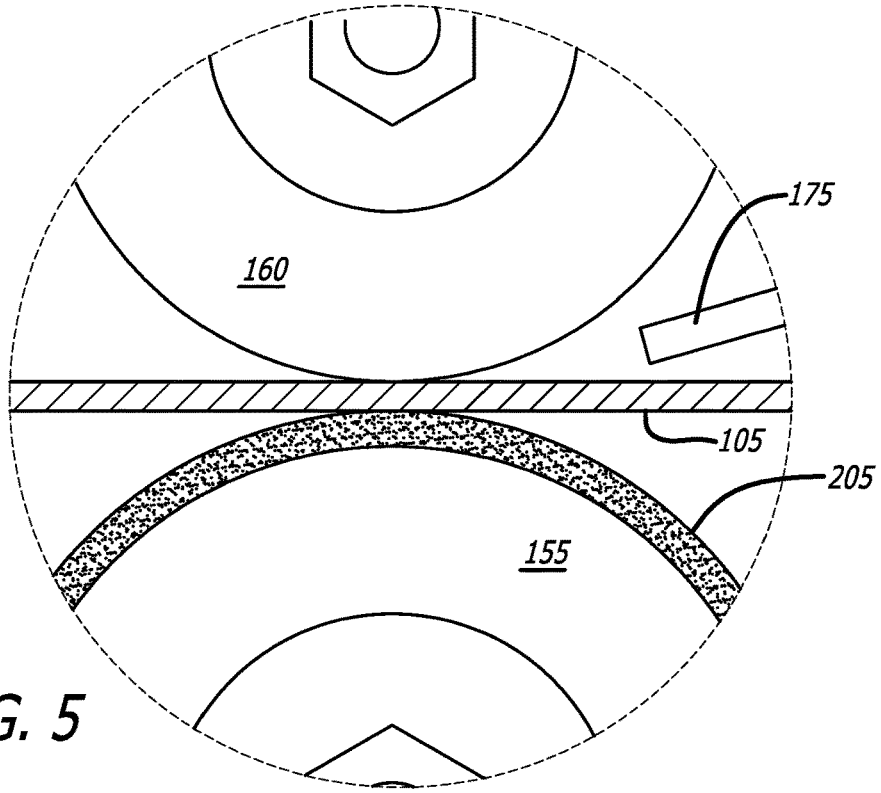
FIG. 5 is an enlarged, cross sectional view of the rollers and ticket interaction of the present invention.
Figure 6:
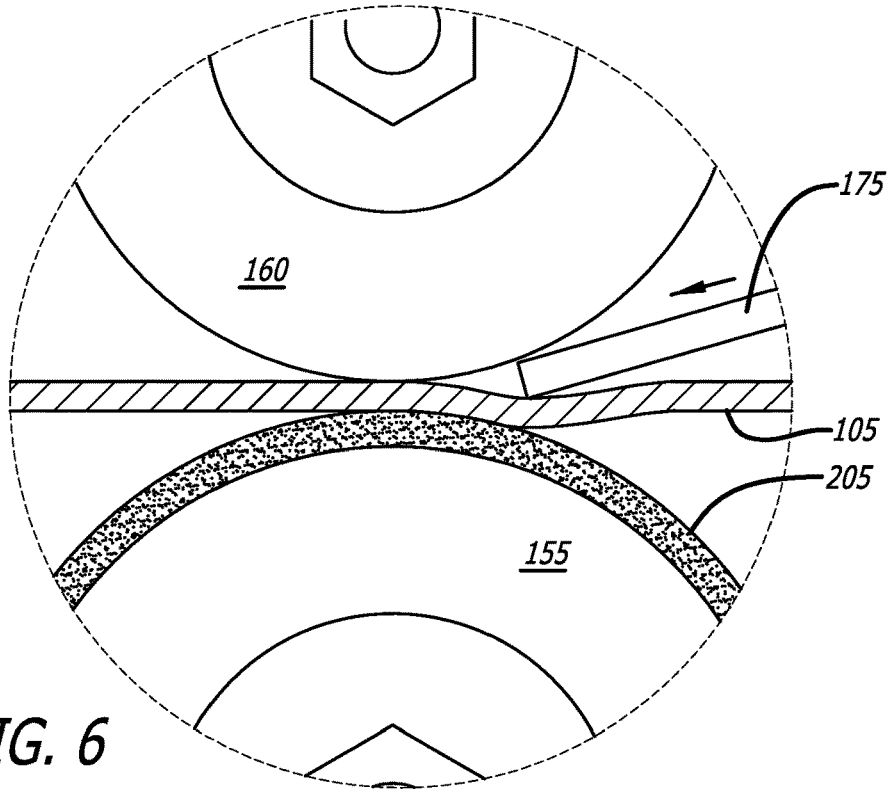
FIG. 6 is an enlarged, cross sectional view of the rollers and ticket with the brake engaged.

To prevent players from pulling on the strand of tickets 105 to extract more tickets, a brake is positioned at the juncture of the drive roller 155 and the idle roller 160. A motor lever or solenoid 170 extends and retracts a wedge or bar 175 based on commands from the processor on the motherboard 130. When the processor stops the motor 135 and the tickets have all been dispensed, the motor lever or solenoid 170 extends the wedge 175 into the rollers 155, 160 as shown in FIGS. 4 and 6. The presence of the wedge 175 jams the ticket against the roller 155, preventing more tickets from being pulled by a player through the slot 32. Rather, the holding of the tickets 105 allow the tickets dispensed to be torn (FIG. 4) at the slot 32 so that a new dispensing operation is ready to begin.

Figure 7:
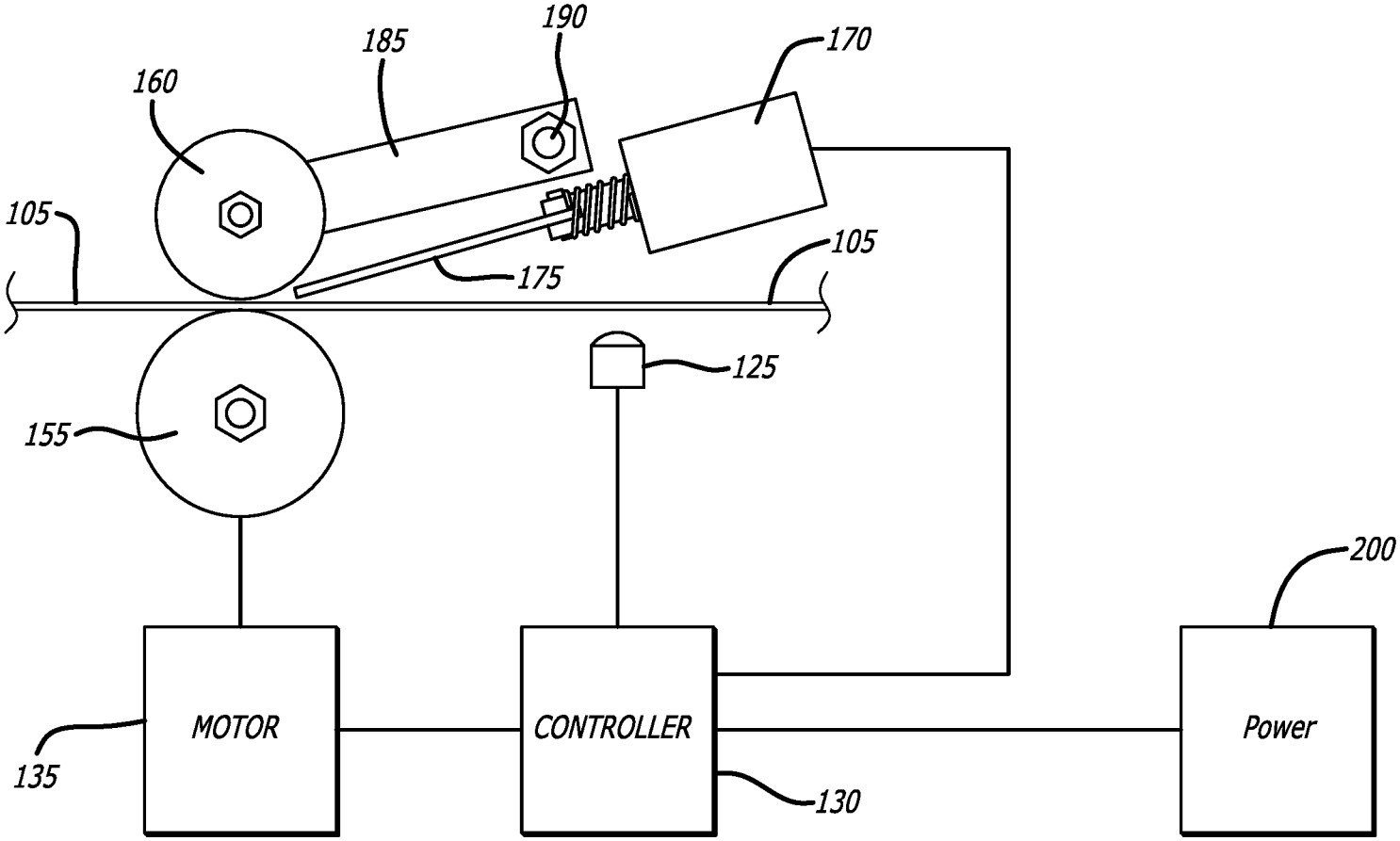
FIG. 7 is a side view of the electronics of the present invention.
Figure 8:
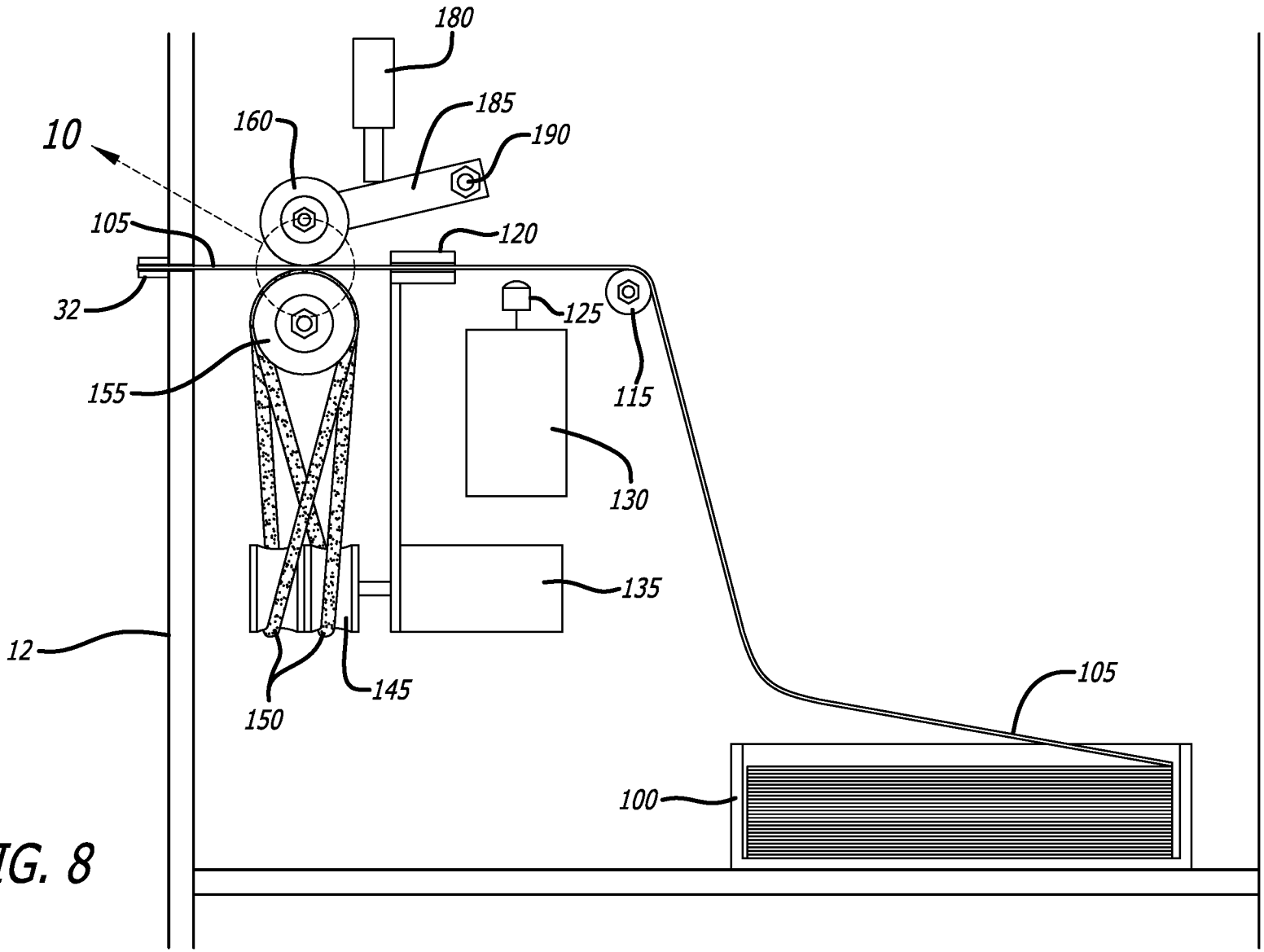
FIG. 8 is a side view of a second embodiment of the present invention.
Figure 9:
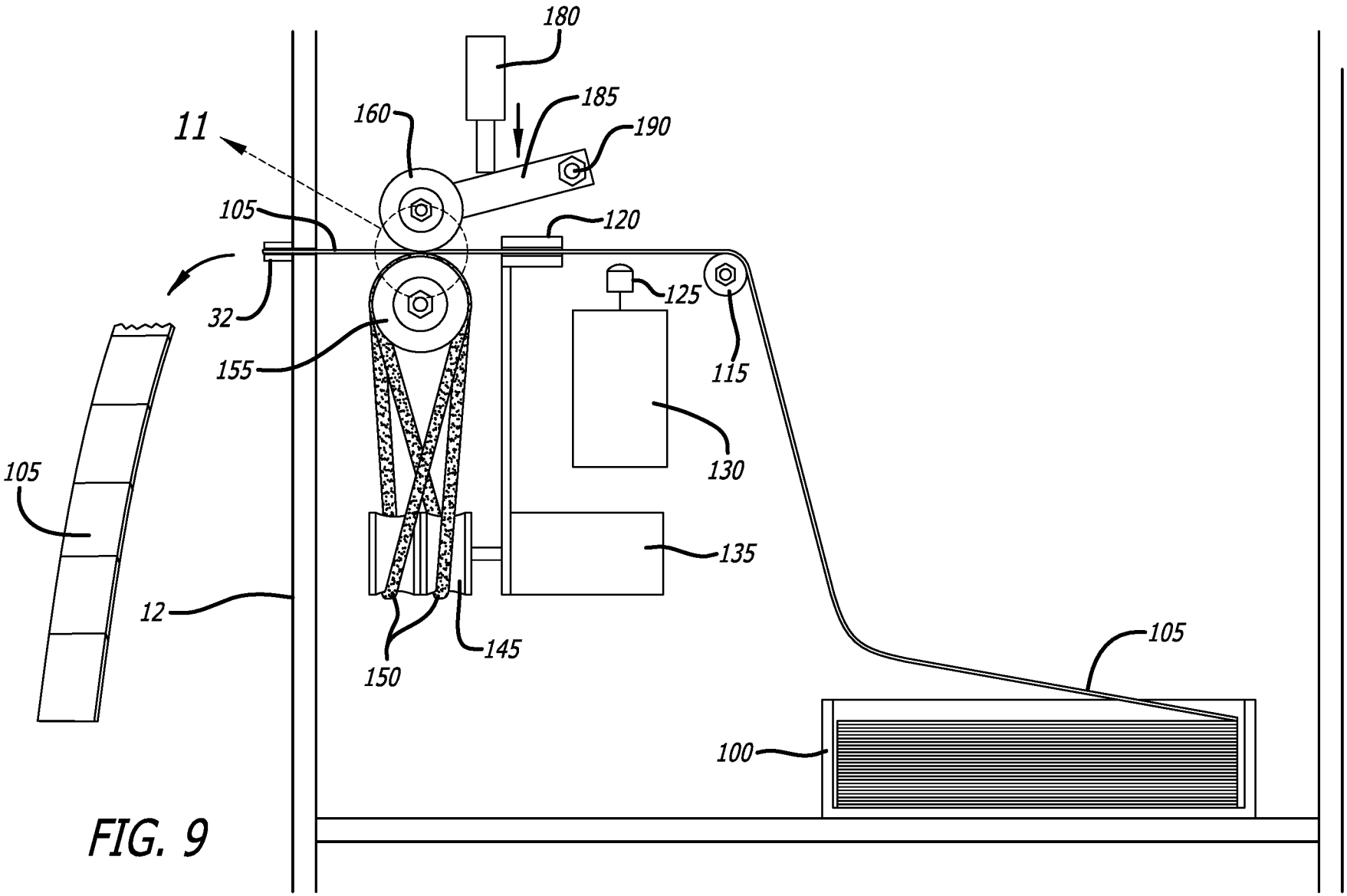
FIG. 9 is a side view of the second embodiment showing the tickets being dispensed.

When the processor determines that a new dispensing operation is needed, the processor sends a signal to the motor 135 to rotate the drum 145. This in turn rotates the drive roller 155 via belts 150 to pull tickets 105 from the tray 100 and push the tickets past the optical reader 125, between the rollers 155, 160, and out the slot 32. When all of the tickets have been dispensed, the processor sends a signal to the motor 135 to stop, which in turn stops the roller 155. The processor also sends a signal to the motor lever or solenoid 170 to activate the brake by extending the wedge 175 into the space between the rollers. This secures the tickets against theft and prevents the rollers from spinning after the motor is turned off. The idle roller control 180 can be adjusted using the processor on the motherboard 130 or manually set and periodically adjusted. The system allows for a high speed ticket dispenser that rapidly and reliably dispenses tickets through a slot of the game at a rate of up to two thousand tickets per minute. FIG. 7 schematically illustrates the ticket distribution system and includes a power supply 200.

Figure 10:
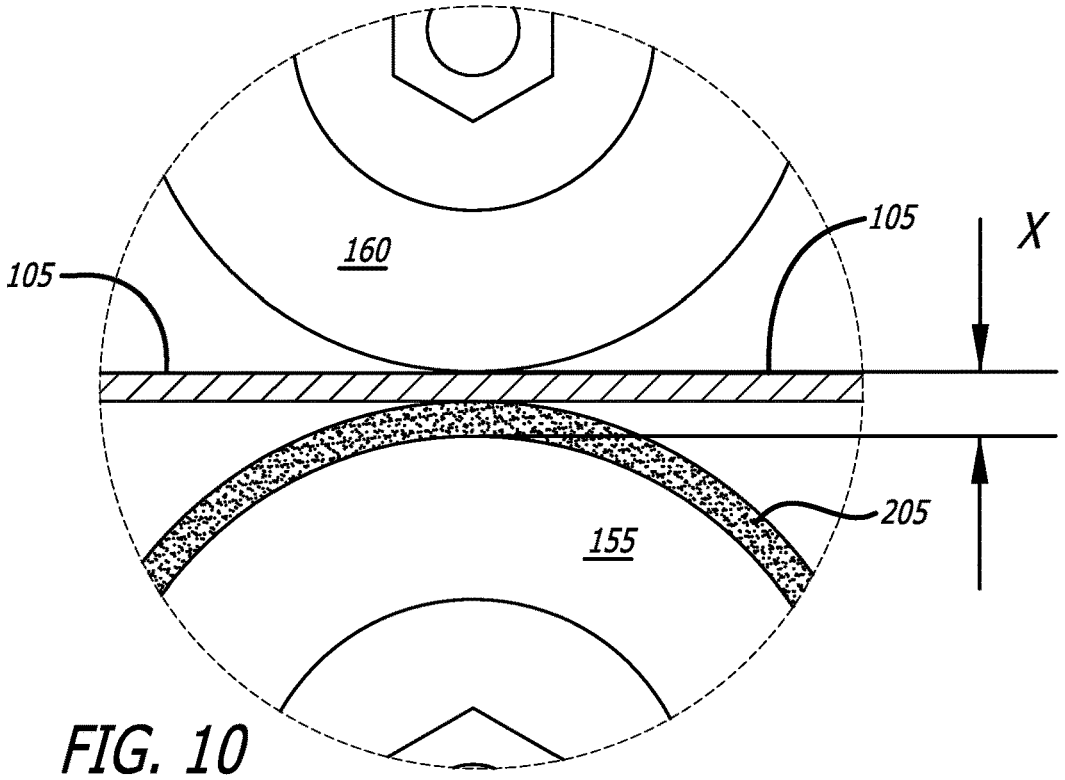
FIG. 10 is an enlarged, cross sectional view of the rollers and ticket interaction of the second embodiment.
Figure 11:
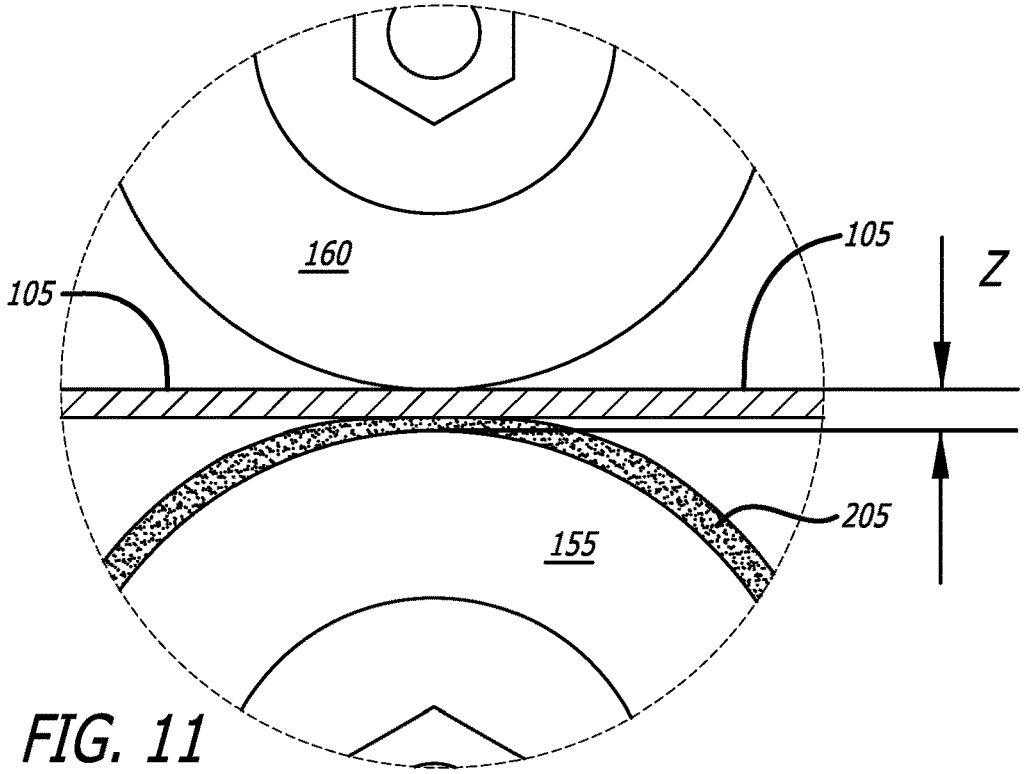
FIG. 11 is an enlarged, cross sectional view of the roller and ticket interaction with the brake applied.

FIGS. 8-11 illustrate a second embodiment whereby the idle roller force control 180 can be used in place of the wedge 175 to squeeze the tickets 105 between the drive roller 155 and the idle roller 160. That is, when the tickets 105 have been distributed, the idle roller solenoid 180 presses down on the radial arm 185 of the idle roller 160 to trap the string of tickets 105 between the two rollers. As seen in FIGS. 10 and 11, the added force reduces the distance between the rollers from "X" to "Z", such that the distance "Z" is sufficient to trap the tickets between the rollers whereas the distance "X" is sufficient to move the tickets smoothly between the two rollers. When the motor 135 is actuated, the solenoid 180 returns to a pressure that moves the tickets instead of traps the tickets. Other braking methods are also possible to prevent tickets from passing through the slot after the motor 135 is disengaged.

While the inventor has disclosed his best mode of carrying out the invention, a person of ordinary skill in the art would readily appreciate many modifications, substitutions, and alterations and the scope of the present invention is intended to include all such modifications, substitutions, and alterations. Moreover, the invention is not limited to the drawings or descriptions above, but is measured by the appended claims using their plain and ordinary meanings.

I claim:

1. A high speed ticket dispenser for an arcade game, comprising:

a supply of connected tickets;

a guide for positioning a leading ticket through a game slot;

a ticket counter;

a controller connected to the ticket counter;

a motor controlled by the controller;

a drive roller actuated by the motor, the drive roller having a smooth circumferential surface;

an idle roller cooperating with the drive roller to move tickets therein between; and an extendable and retractable brake controlled by the controller and adapted to wedge between the drive roller and the idle roller to wedge a ticket against the drive roller when the motor is disengaged to prevent further movement of the tickets past the drive roller.

2. The high speed ticket dispenser of claim 1, wherein the extendable and retractable brake is moved by a solenoid.

3. The high speed ticket dispenser of claim 1, wherein the supply of connected tickets is a tray of fan-folded tickets.

4. The high speed ticket dispenser of claim 1, wherein an axis of rotation of the drive roller is perpendicular to an axis of rotation of the motor.

5. The high speed ticket dispenser of claim 1, further comprising a force applicator to control a counterforce of the idle roller against the drive roller.

6. The high speed ticket dispenser of claim 1, wherein the ticket counter is an optical sensor.

* * * * *